United States Patent [19]

Rupprecht

[11] Patent Number: 4,705,272

[45] Date of Patent: Nov. 10, 1987

[54] ITEM OF SPORTS EQUIPMENT OR GAMES DEVICE

[76] Inventor: Christian Rupprecht, Wiesentalstrasse 46, 7913 Senden, Fed. Rep. of Germany

[21] Appl. No.: 831,197

[22] Filed: Feb. 20, 1986

[51] Int. Cl.[4] ..... A63B 21/00

[52] U.S. Cl. ..... 272/146; 272/114

[58] Field of Search ..... 272/145, 146, 40, 43, 272/111, 114; D21/227, 71, 102; 280/87.04 A, 87.04 R

[56] References Cited

U.S. PATENT DOCUMENTS

| | | | |
|---|---|---|---|
| 3,108,802 | 10/1963 | Sundquist | 272/146 |
| 3,361,427 | 1/1968 | Paves | 272/146 |
| 3,895,794 | 7/1975 | England | 272/146 |
| 4,095,817 | 6/1978 | Cohen | 280/87.04 A |
| 4,108,452 | 8/1978 | Baron | 280/87.04 A |
| 4,285,516 | 8/1981 | Heatwole | 272/146 |

*Primary Examiner*—Richard J. Apley
*Assistant Examiner*—James Prizant
*Attorney, Agent, or Firm*—Sughrue, Mion, Zinn, Macpeak, and Seas

[57] ABSTRACT

An item of sports equipment or a games device comprising a supporting plate which provides space for two feet and which is equipped with rotatable elements, wherein the supporting plate has a camber on the upper side, and at least one horizontally rotatable supporting disk is arranged to be attached near to each end of the under side.

11 Claims, 2 Drawing Figures

ITEM OF SPORTS EQUIPMENT OR GAMES DEVICE

Figure 1:
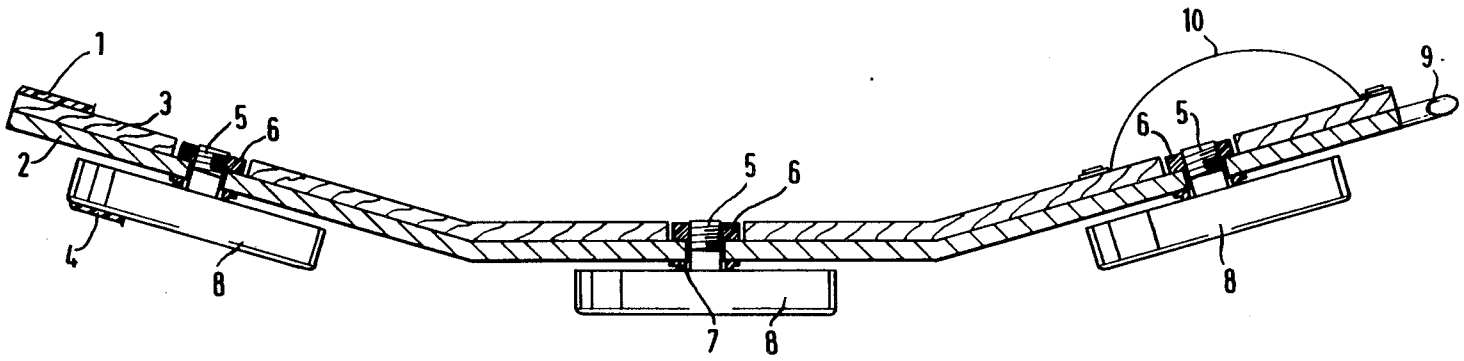

The invention relates to an item of sports equipment or a games device comprising a supporting plate providing room for two feet, with rotatable elements situated on it.

A multiplicity of sports and games equipment for physical training, and particularly muscle training is already known. Some of this equipment is used in games, since enjoyment of physical movement is of primary importance. Developments such as roller skates or skate boards, which in recent times have been widely distributed, are to be included in the latter category.

The object of the present invention is to provide a novel item of sports equipment or a games device that can be used not only for physical training but also solely for the enjoyment of games and exercise. At the same time the device should be simple in construction and thus favorably priced, but above all it should be safe to handle and permit a multitude of different movements. According to one embodiment of the present object the device should be capable of serving in similar ways as a piece of keep-fit equipment, a piece of schools' gymnastic equipment and as a games device, e.g. for children and young people.

This object is accomplished by the provision of an item of sports equipment or a games device of the type mentioned hereinbefore, characterized in that at least one supporting disk (8) arranged to be horizontally rotatable is attached to the underside of each of the end regions of the supporting plate (3) and in that the supporting plate has an upwards orientated camber.

The surface of the supporting plate may have a wide variety of shapes. The supporting plate may be shaped in a particularly convenient way as a rectangle, whose corners may if necessary be rounded. Normally the supporting plate has an elongated form and can be broadened at the ends to provide space for the feet. Conversely, the for example preferably rectangular-shaped supporting plate may have a reduced width in its central region to improve the turnability of the device. In this case a club-shaped sectional plane results.

It is advantageous if the camber of the supporting plate and the size of the horizontally rotatable supporting disks are so matched that the device rests on the outer areas of the supporting disks. In principle it is actually also possible that the camber of the supporting plate is very small, even tending towards zero. It is particularly advantageous, however, if the supporting plate displays a certain arching in the end regions, as this facilitates the displacement of the weight of the operator onto the peripheral surfaces and thus the maneuverability of the device in a Z-shaped direction on displacement of the device on the ground.

According to a preferred embodiment of the item of sports equipment or games device according to the invention the supporting plate is level in the central region, and the respective end portions are arched at an angle alpha to the support plane, wherein $0<\text{alpha}<45°$.

The length of the supporting plate is preferably matched to the width of the stance of the operator, e.g. of children or young people. Naturally it is also possible to decide upon the stance width of an adult or on some value for the stance width in that area. The supporting plate should be able to receive at least the surface area of the feet, and for this purpose it may be broadened in the end regions. There should, however, be a sufficiently large surface area present in the central region for the operator to carry out exercises, gymnastic games and football training in a sitting or if necessary lying position.

According to a preferred embodiment of the device according to the invention the supporting plate has at least one but preferably two hand grips in the end regions. This may facilitate transport of the device as well as permit maintenance of a hand grip on carrying out muscle training such as press-ups with forward movement, etc. It may also be convenient to put bindings on the upper surface of the supporting plate which may for example make it easier to keep the feet of the operator in place.

Where the item of sports equipment or games device has only two flat supporting disks arranged to be horizontally rotatable attached to the underside of the peripheral regions it is preferable that the supporting disks are symmetrical with respect to distance from the middle of the supporting plate. A particularly preferred device according to the invention is characterized in that the supporting plate has a further supporting disk which is arranged to be horizontally rotatable in the middle of the underside. In this way the turning movements of the device and movements arising from local displacement of the device are partly made easier and it also permits the operator to add movements of his own. In the event of the device having an additional horizontally rotatable supporting disk in the center it is advantageous when the device lies on it. A symmetrical rotation centered on this supporting disk is then possible. Alternatively, on weight transfer onto a peripheral area a turning or other position-altering movement originating from this peripheral area can be achieved.

It is also possible to have one or more additional arched side wings on the supporting plate each of which may have a further horizontally rotatable supporting disk attached near its end. Thus a three or four-limbed form of the supporting plate is possible within the scope of the invention.

The attachment of the supporting disks to the supporting plate can be effected in any normal way as long as the horizontal rotatability of the device is not significantly affected. The supporting disks can thus be screwed to bolts sunk into the supporting plate etc. It is also suitable that the supporting plate be equipped with a non-slip cover where it is not already constructed out of a non-slip material itself. It is preferred that the device, or at least the supporting plate and the supporting disks are made out of synthetic material. The attachment of the supporting disks to the supporting plates can be carried out in the normal way using nuts and bolts made from synthetic material and with built-in ball bearings, although it is generally preferred for mechanical strength reasons to use attaching means made out of metal. Alternatively, the whole device can be made from metal, e.g. a light metal such as aluminum.

In a preferred embodiment the item of sports equipment or games device according to the invention is available in kit form comprising the supporting plate, the supporting disks, nuts, bolts, ball bearings, as well as the tools necessary to put the components together. Depending on the precise form of the device according to the invention the necessary tool may simply be a spanner. The provision of the device according to the invention in kit form provides the possibility of additional enjoyment for children and young people in that they may build the operational device themselves.

The device according to the invention is described in more detail in the appended figures.

Figure 2:
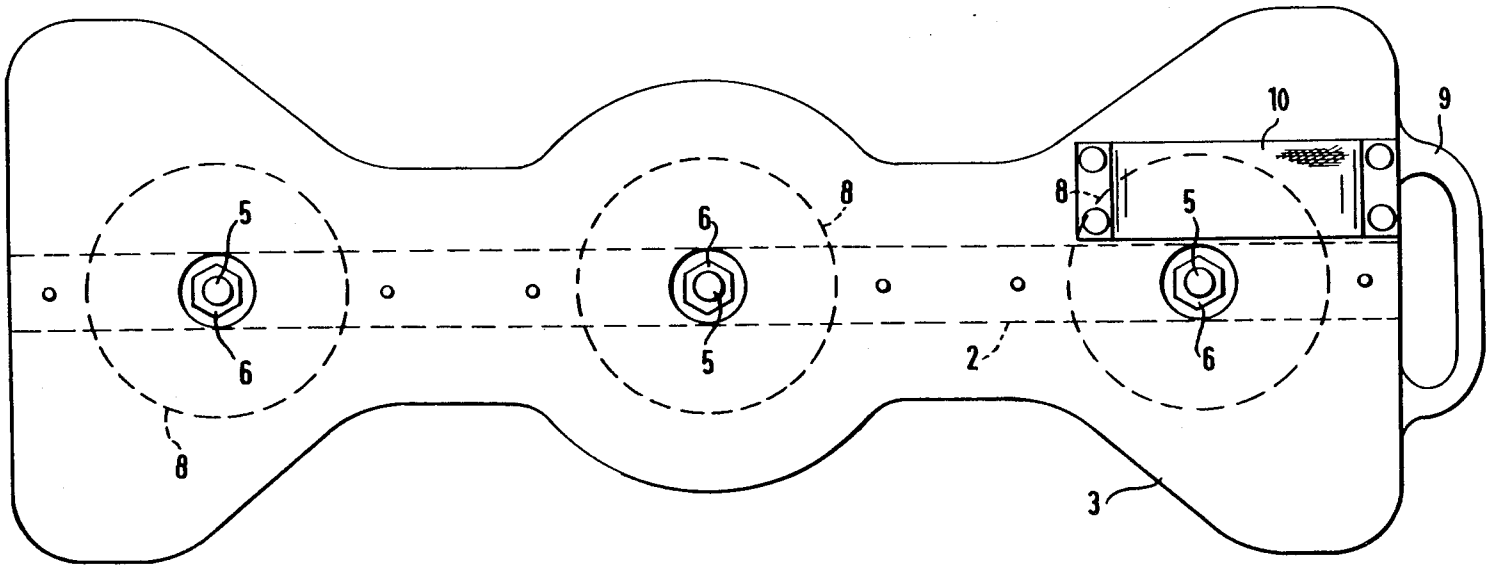

FIG. 1 shows a side view of one form of the device according to the invention, and FIG. 2 shows a plan view of this form.

A plywood plate 3 to whose support surfaces near the end is adhered a non-slip synthetic cover 1, is arranged on a flat bar 2. The supporting disks 8 are arranged on the underside of the device by means of bolts 5, nuts 6 as well as spacers 7 which permit a horizontal rotatability. The supporting disks may be made of synthetic material or a light metal. In the latter case the flat supporting undersides may be equipped with a layer of material that may influence maneuverability, e.g. rubber. From the plan view the elongated form of the supporting plate which is broadened near the ends is readily recognizable.

The device according to the invention permits a wide variety of different turning movements effected from the standing, sitting or lying position. Traveling movements for example in the standing position are, however, also possible wherein turning of the device may be effected by applying pressure to an outer edge and transferring body weight either forwards or backwards etc. around the axis of the load-bearing wheel. At the same time a tilting of the device is achieved by weight transfer onto the peripheral, non-load-bearing supporting disk. As can be readily recognized from the construction of the device and the above description, combined turning and traveling movements are also possible.

The device according to the invention may be used in many different ways. It permits a development of a sense of balance or also physical training through continual total body movement. It is therefore also suitable as an exercise machine, a piece of schools' gymnastic equipment, etc. At the same time forwards, backwards, or sideways "standing traveling movements" are possible as well as the describing of figures which may be completed by means of "built-in" turns. "Sitting traveling movements" are, however, also possible. In another form the device may be operated with the arms in, for example, a lying position whereby a traveling movement in a forwards or backwards direction may, if necessary, be achieved. As a consequence of the easy horizontal rotatability of the device, rhythmic movements for example to music as well as acrobatic exercises are possible.

The device may be made suitable for use by partners by being equipped with several limbs, for example, it may have a star-shape with three or four limbs, etc. In most cases the device is made completely from synthetic materials since light weight improves the maneuverability of the device when in motion. It is also possible to alter the size, material of construction, movability, turnability, etc. of the supporting disks according to the effect it is desired to achieve.

I claim:

1. An item of sports equipment comprising a supporting plate having upper and lower surfaces comprising a central portion and opposite upwardly inclined end portions, a first rotatable support disk mounted on the under surface of said central portion for rotation about an axis perpendicular to said central portion and second and third rotatable supporting disks disposed symmetrically relative to said central portion mounting on the undersurfaces of said end portions respectively for rotation about respective axes disposed perpendicular to said end portions.

2. An item of sports equipment according to claim 1 wherein said supporting plate has a substantially rectangular configuration.

3. An item of sports equipment according to claim 1 wherein said supporting plate has an elongated form which is broadened at the ends.

4. An item of sports equipment according to claim 1 wherein the camber of said supporting plate and the size of said rotatable supporting disks are matched such that the item rests on the outer regions of the supporting disks.

5. An item of sports equipment according to claim 1 wherein said central portion and each of said side portions are comprised of three flat plates with the end portions being disposed at an angle alpha to the central portion wherein $0<\text{alpha}<45°$.

6. An item of sports equipment according to claim 1 wherein the length of said supporting plate corresponds to the stance width and further including binding means for the feet secured to the upper surface of said supporting plate.

7. An item of sports equipment according to claim 1 further comprising at least one handle secured to said support plate adjacent to one end thereof.

8. An item of sports equipment according to claim 1 wherein said supporting disks are rotatably mounted on bolts secured to said supporting plate.

9. An item of sports equipment according to claim 1 further comprising nonslip means secured to the upper surface of said supporting plate.

10. An item of sports equipment according to claim 1 wherein said supporting plate and said supporting disks are comprised of synthetic material.

11. An item of sports equipment according to claim 1 wherein said supporting plate and said supporting disks are made of light metal.

* * * * *